US009528729B2

(12) United States Patent
Tachibana et al.

(10) Patent No.: US 9,528,729 B2
(45) Date of Patent: Dec. 27, 2016

(54) HEAT TRANSFER UNIT AND TEMPERATURE ADJUSTMENT DEVICE

(71) Applicant: KEENUSDESIGN CORPORATION, Higashimurayama-shi, Tokyo (JP)

(72) Inventors: Junichi Tachibana, Higashimurayama (JP); Shinichiro Iwasaki, Hino (JP)

(73) Assignee: KeenusDesign Corporation, Tokyo (JP)

( * ) Notice: Subject to any disclaimer, the term of this patent is extended or adjusted under 35 U.S.C. 154(b) by 183 days.

(21) Appl. No.: 14/390,254

(22) PCT Filed: Apr. 5, 2013

(86) PCT No.: PCT/JP2013/060514
§ 371 (c)(1),
(2) Date: Oct. 2, 2014

(87) PCT Pub. No.: WO2013/157417
PCT Pub. Date: Oct. 24, 2013

(65) Prior Publication Data

US 2015/0107272 A1 Apr. 23, 2015

(30) Foreign Application Priority Data

Apr. 17, 2012 (JP) ..... 2012-107084
Nov. 16, 2012 (JP) ..... 2012-251848

(51) Int. Cl.
*F25B 21/02* (2006.01)

(52) U.S. Cl.
CPC ..... *F25B 21/02* (2013.01); *F25B 2321/023* (2013.01); *F25B 2321/0212* (2013.01)

(58) Field of Classification Search
CPC ..... F25B 2321/0212; F25B 2321/023
See application file for complete search history.

(56) References Cited

U.S. PATENT DOCUMENTS 3,151,465 A * 10/1964 Gelbtuch ..... F25B 21/02 136/204
5,865,031 A * 2/1999 Itakura ..... F25B 21/02 62/3.7

(Continued)

FOREIGN PATENT DOCUMENTS

CN 1249067 A 3/2000
EP 0 967 665 A1 12/1999

(Continued)

OTHER PUBLICATIONS

International Preliminary Report on Patentability issued in International Application No. PCT/JP2013/060514 dated Oct. 21, 2014.

(Continued)

*Primary Examiner* — Emmanuel Duke
(74) *Attorney, Agent, or Firm* — Oliff PLC

(57) ABSTRACT

A temperature adjustment device includes: at least one first Peltier unit having a heat absorption surface and a heat release surface; at least one second Peltier unit having a heat absorption surface and a heat release surface; a controller which controls the drive currents of the first Peltier unit and the second Peltier unit; a primary circulation mechanism which circulates a primary refrigerant between a first heat release block and a heat absorption block; at least one second heat release block which has a flow path through which a secondary refrigerant flows, receives heat from the heat release surface of the second Peltier unit and transmits the heat to the secondary refrigerant; a heat exchanger which receives the secondary refrigerant discharged from the second heat release block and releases heat; and a secondary circulation mechanism which circulates the secondary refrigerant between the second heat release block and the heat exchanger.

6 Claims, 14 Drawing Sheets

(56) References Cited

U.S. PATENT DOCUMENTS

| | | | | |
|---|---|---|---|---|
| 5,918,469 | A * | 7/1999 | Cardella | F25B 21/02 165/80.3 |
| 6,125,635 | A | 10/2000 | Nomura et al. | |
| 6,185,941 | B1 | 2/2001 | Watanabe et al. | |
| 2004/0262541 | A1 * | 12/2004 | Honda | F25B 21/02 250/492.2 |

FOREIGN PATENT DOCUMENTS

| | | |
|---|---|---|
| JP | B-38-19240 | 9/1963 |
| JP | A-11-173701 | 7/1999 |
| JP | A-11-186617 | 7/1999 |
| JP | 2000124509 A * | 4/2000 |
| JP | A-2000-124509 | 4/2000 |
| JP | A-2001-336854 | 12/2001 |
| JP | A-2002-314154 | 10/2002 |
| JP | 2003225839 A * | 8/2003 |
| JP | A-2003-225839 | 8/2003 |
| JP | A-2008-514895 | 5/2008 |
| WO | WO 99/34451 A1 | 7/1999 |
| WO | WO 2006/037178 A1 | 4/2006 |
| WO | WO 2009/150725 A1 | 12/2009 |

OTHER PUBLICATIONS

International Search Report issued in International Application No. PCT/JP2013/060514 mailed Jul. 9, 2013.

* cited by examiner

HEAT TRANSFER UNIT AND TEMPERATURE ADJUSTMENT DEVICE

FIELD OF THE INVENTION

The present invention relates to a heat transfer unit and a temperature adjustment device. In particular, the present invention relates to a heat transfer unit and a temperature adjustment device, in both of which a Peltier element and a liquid-cooling mechanism are combined.

BACKGROUND ART

As a temperature adjustment device that makes use of a Peltier element, a device is known in which a heat release surface is covered with a liquid jacket and a refrigerant is circulated in the liquid jacket. In addition, a cooling device is known in which, in order to enhance the heat release effect of a Peltier element by a refrigerant, a chiller is provided in a circulation system path of the refrigerant and a liquid cooled in the chiller is supplied to a liquid jacket (see, for example, Patent Document 1).

PRIOR ART REFERENCES

Patent Documents

Patent Document 1: JP2003-225839A

SUMMARY OF THE INVENTION

Problems to be Solved by the Invention

With a configuration in which a refrigerant for cooling a Peltier element is cooled by a chiller, quietness may be lost due to the vibration and noise of the chiller. In addition, it is difficult to downsize a chiller having a compressor and also to vary the configuration in accordance with the cooling capability.

Accordingly, it is an object of the present invention to provide a temperature adjustment device which can solve the above-described problems. This object can be achieved by a combination of the features described in the independent claims in the claims. The dependent claims define further advantageous specific examples of the present invention.

Means for Solving the Problems

In order to achieve the object set forth above, a temperature adjustment device according to a first embodiment of the present invention includes: at least one first Peltier element having a heat absorption surface and a heat release surface; at least one second Peltier element having a heat absorption surface and a heat release surface; a controller that controls a drive current of the first Peltier element and the second Peltier element; at least one first heat release block that has a flow path in which a primary refrigerant flows, the at least one first heat release block being thermally coupled to the heat release surface of the first Peltier element, receiving heat from the heat release surface of the first Peltier element and transferring the heat to the primary refrigerant; at least one heat absorption block that has a flow path in which the primary refrigerant discharged from the first heat release block flows, the at least one heat absorption block being thermally coupled to the heat absorption surface of the second Peltier element, transferring heat of the primary refrigerant flowing in the flow path to the heat absorption surface of the second Peltier element; a primary circulation mechanism that circulates the primary refrigerant between the first heat release block and the heat absorption block; at least one second heat release block that has a flow path in which a secondary refrigerant flows, the at least one second heat release block receiving heat from the heat release surface of the second Peltier element and transferring the heat to the secondary refrigerant; a heat exchanger that receives the secondary refrigerant discharged from the second heat release block and releases heat thereof; and a secondary circulation mechanism that circulates the secondary refrigerant between the second heat release block and the heat exchanger.

In order to achieve the object set forth above, a heat transfer unit according to a second embodiment of the present invention includes: a Peltier element that has a first surface functioning as a heat absorption surface or a heat release surface, depending on the direction of a drive current, and a second surface functioning as a surface different from the first surface, out of the heat absorption surface or the heat release surface, depending on the direction of the drive current; a first heat transfer block that has a flow path in which a heat medium flows, the first heat transfer block being thermally coupled to the first surface or the second surface of the Peltier element and transferring heat between the coupled surface and the heat medium; and a storage container that seals therein the Peltier element and the first heat transfer block in an air-tight manner.

In order to achieve the object set forth above, a temperature adjustment device according to a third embodiment of the present invention includes: at least one first Peltier element that has a first surface functioning as a heat absorption surface or a heat release surface, depending on the direction of a drive current, and a second surface functioning as a surface different from the first surface, out of the heat absorption surface or the heat release surface, depending on the direction of the drive current; at least one second Peltier element that has a first surface functioning as a heat absorption surface or a heat release surface, depending on the direction of a drive current, and a second surface functioning as a surface different from the first surface, out of the heat absorption surface or the heat release surface, depending on the direction of the drive current; a controller that controls the drive current of the first Peltier element and the second Peltier element; at least one first heat transfer block that has a flow path in which a primary heat medium flows, the at least one first heat transfer block being thermally coupled to the second surface of the first Peltier element and transferring heat between the second surface of the first Peltier element and the primary heat medium; a first storage container that seals the first Peltier element and the first heat transfer block in an air-tight manner; a heat adjustment stage that is thermally coupled to the first surface of the first Peltier element, part of the heat adjustment stage being exposed at the first storage container; at least one second heat transfer block that has a flow path in which the primary heat medium discharged from the first heat transfer block flows, the at least one second heat transfer block being thermally coupled to the first surface of the second Peltier element and transferring heat between the first surface of the second Peltier element and the primary heat medium; a primary circulation mechanism that circulates the primary heat medium between the first heat transfer block and the second heat transfer block; at least one third heat transfer block that has a flow path in which a secondary heat medium flows, the at least one third heat transfer block being thermally coupled to the second surface of the second Peltier element and transferring heat between the second surface of the second Peltier element and the secondary heat medium; a heat exchanger that receives the secondary heat medium discharged from the third heat transfer block and releases the heat thereof; a secondary circulation mechanism that circulates the secondary heat medium between the third heat transfer block and the heat exchanger; and a second storage container that seals the second Peltier element, the second heat transfer block and the third heat transfer block in an air-tight manner.

It should be noted that the summary of the invention described above does not enumerate all of the necessary features of the present invention, and any sub-combination from a group of these features may form an invention.

BRIEF DESCRIPTIONS OF THE DRAWINGS

Figure 4:
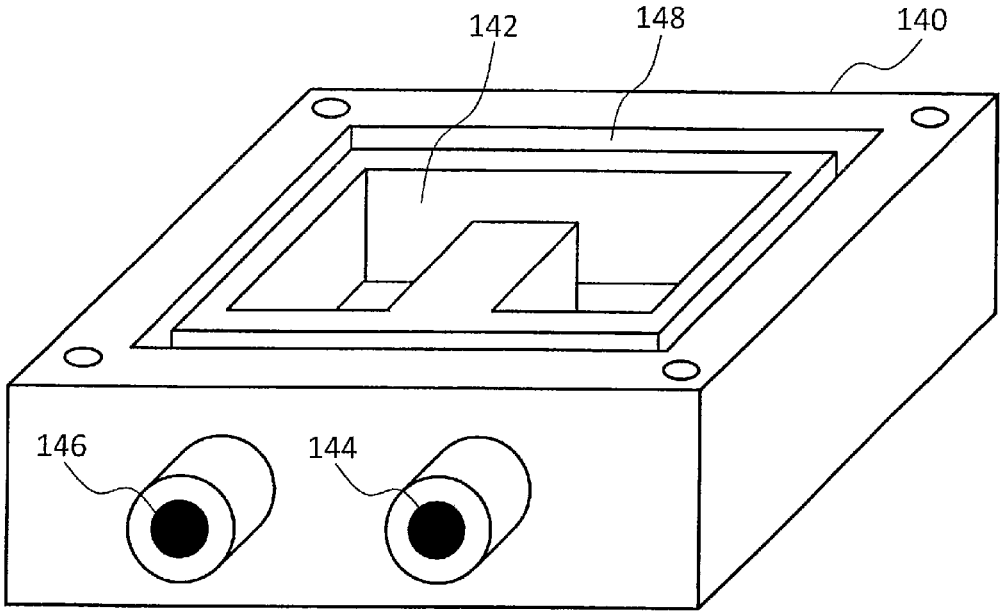
FIG. 4 shows another example of the first heat release block 140 used in the first embodiment.
Figure 5:
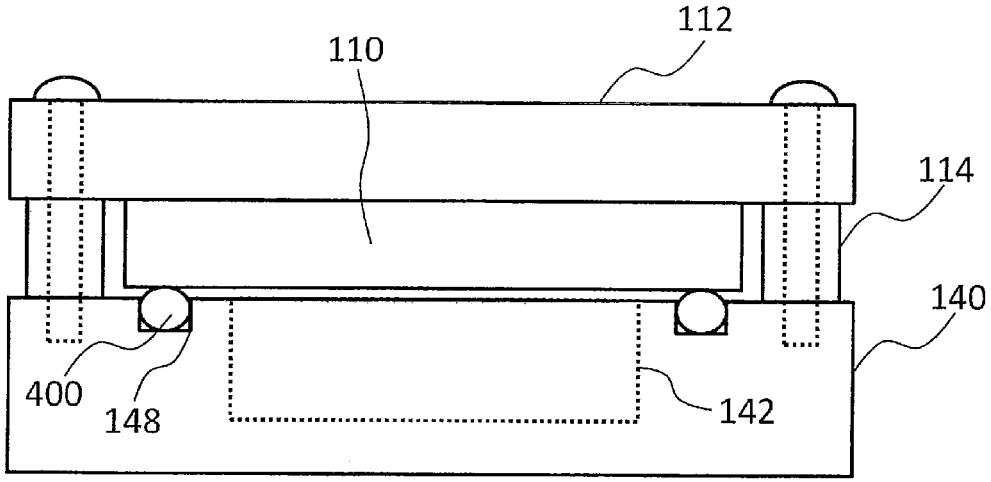

FIG. 5 shows a cross-sectional view of a heat absorption plate 112, a first Peltier element 110 and a first heat release block 140 in a condition where the first Peltier element 110 is attached to the first heat release block 140 shown in FIG. 4.

Figure 6:
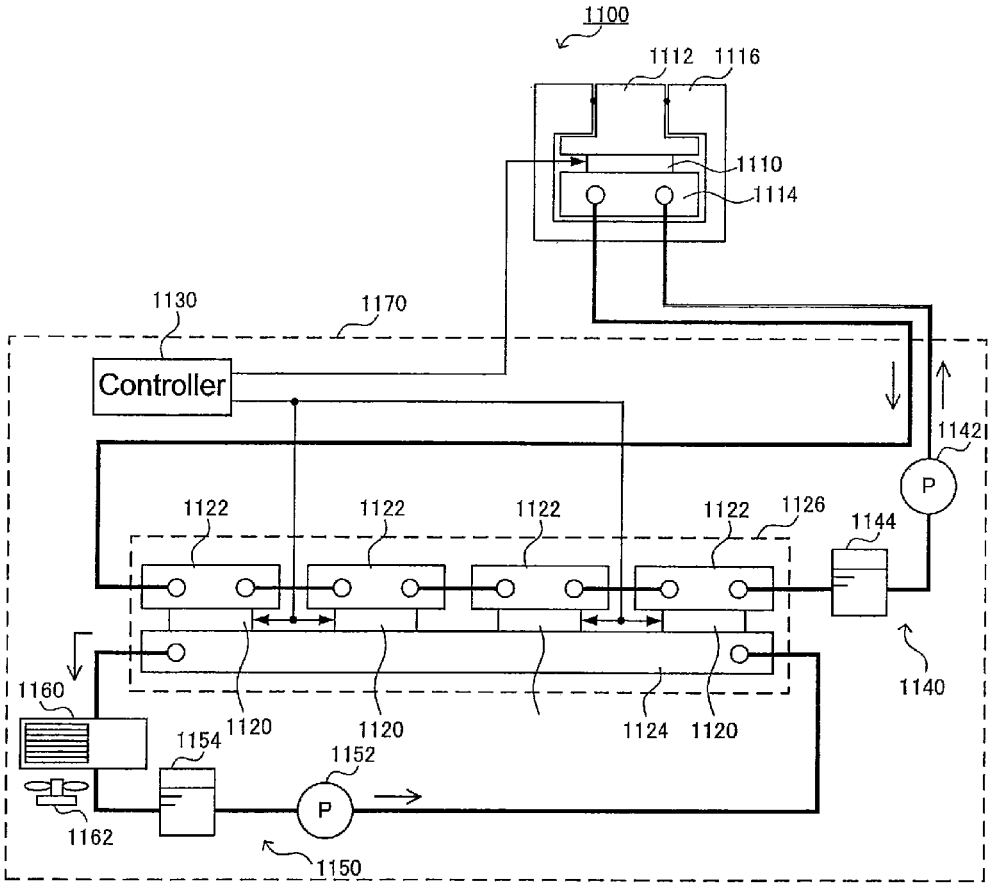

FIG. 6 shows a configuration of a temperature adjustment device 1100 according to a second embodiment of the present invention.

Figure 7:
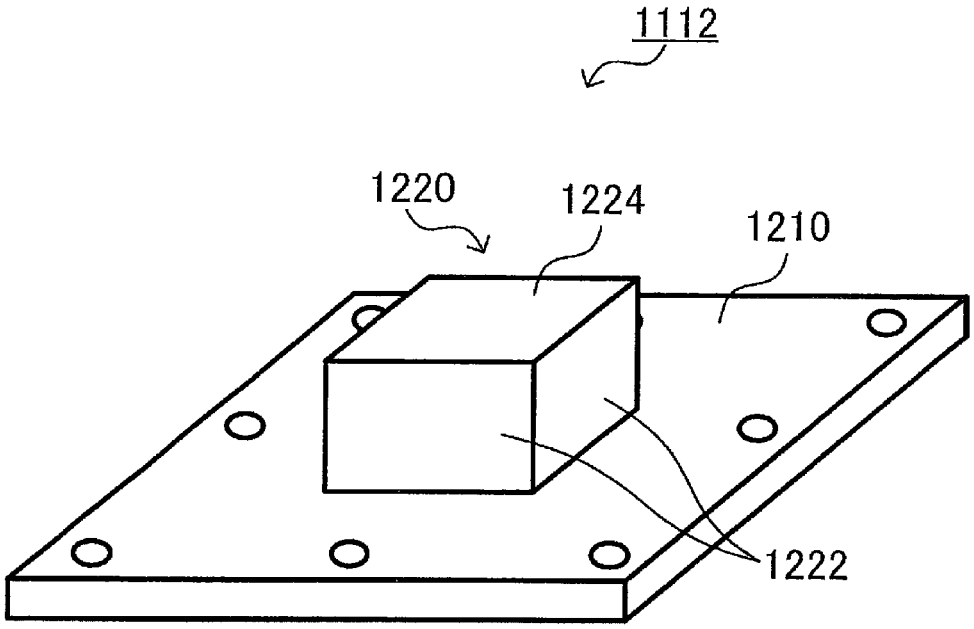

FIG. 7 shows an example of an exterior appearance of a heat adjustment stage 1112.

Figure 8:
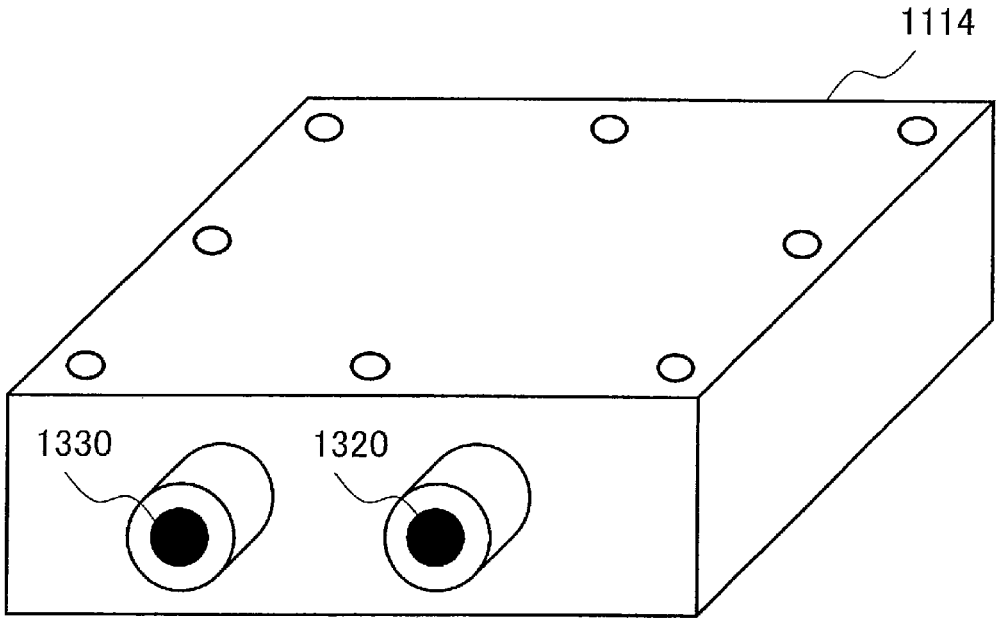

FIG. 8 shows an example of an exterior appearance of a first heat transfer block 1114.

Figure 9:
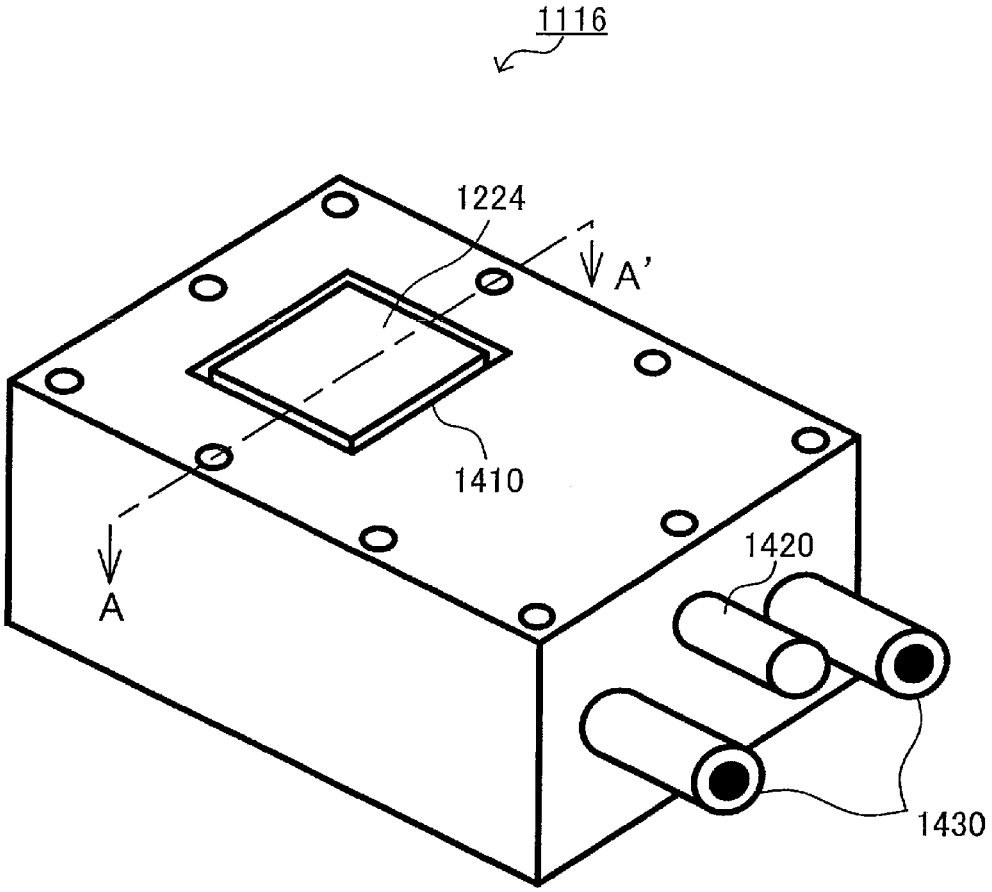

FIG. 9 shows an external appearance of a first storage container 1116 having a first Peltier element 1110, a heat adjustment stage 1112 and a first heat transfer block 1114 stored therein.

Figure 10:
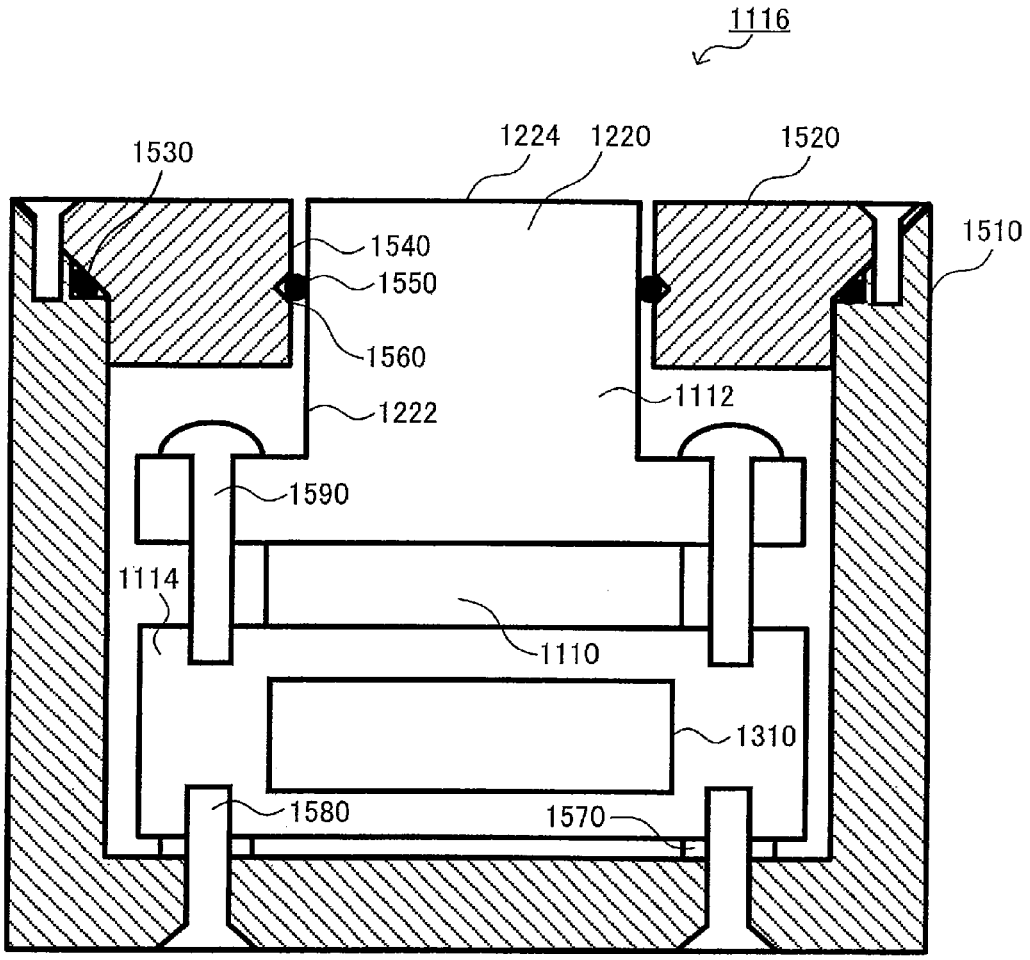

FIG. 10 shows a cross-sectional view along line A-A' in FIG. 9.

Figure 11:
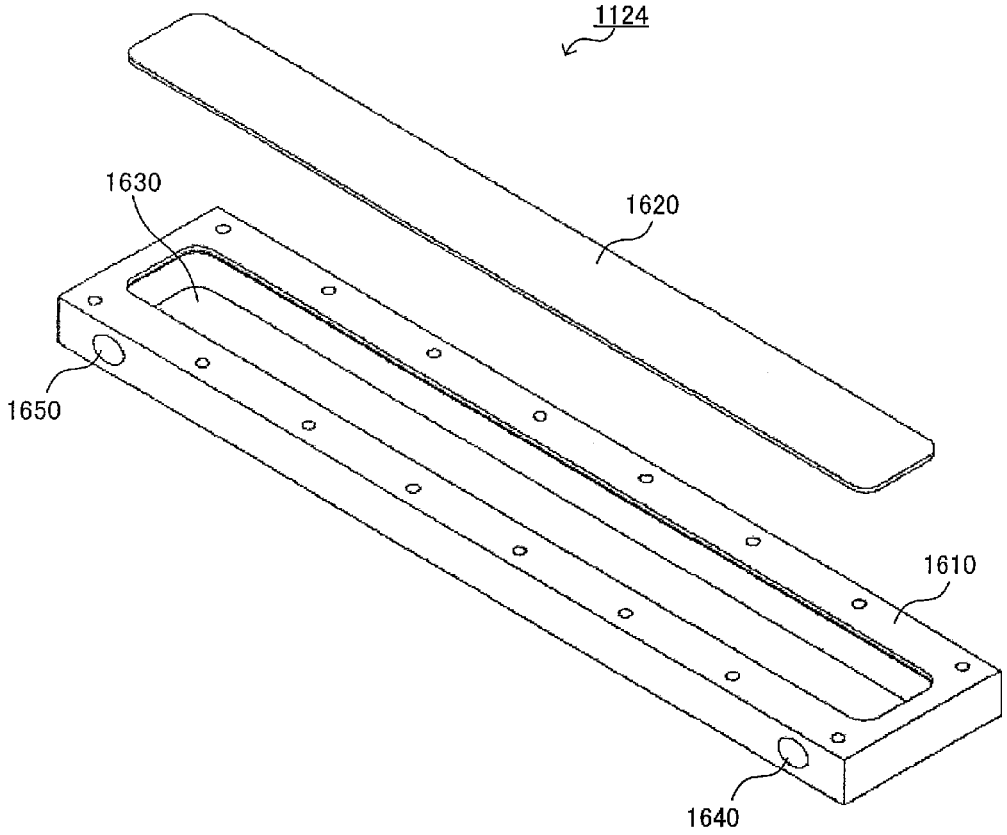

FIG. 11 shows an exterior appearance of a third heat transfer block 1124.

Figure 12:
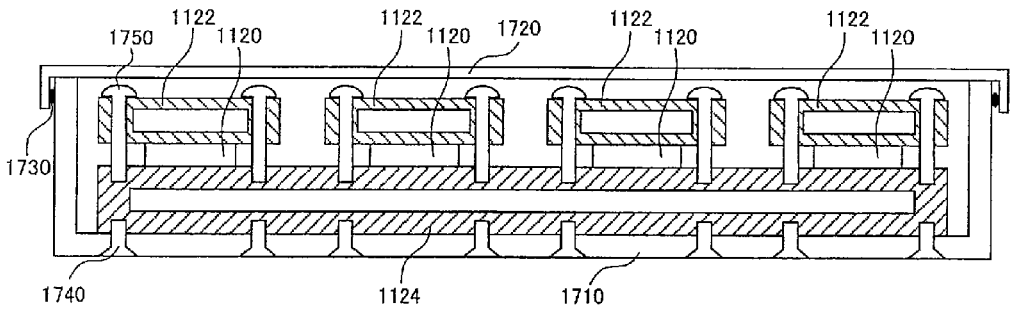

FIG. 12 shows a second Peltier element 1120, a second heat transfer block 1122 and a third heat transfer block 1124 stored in a second storage container 1126.

Figure 13:
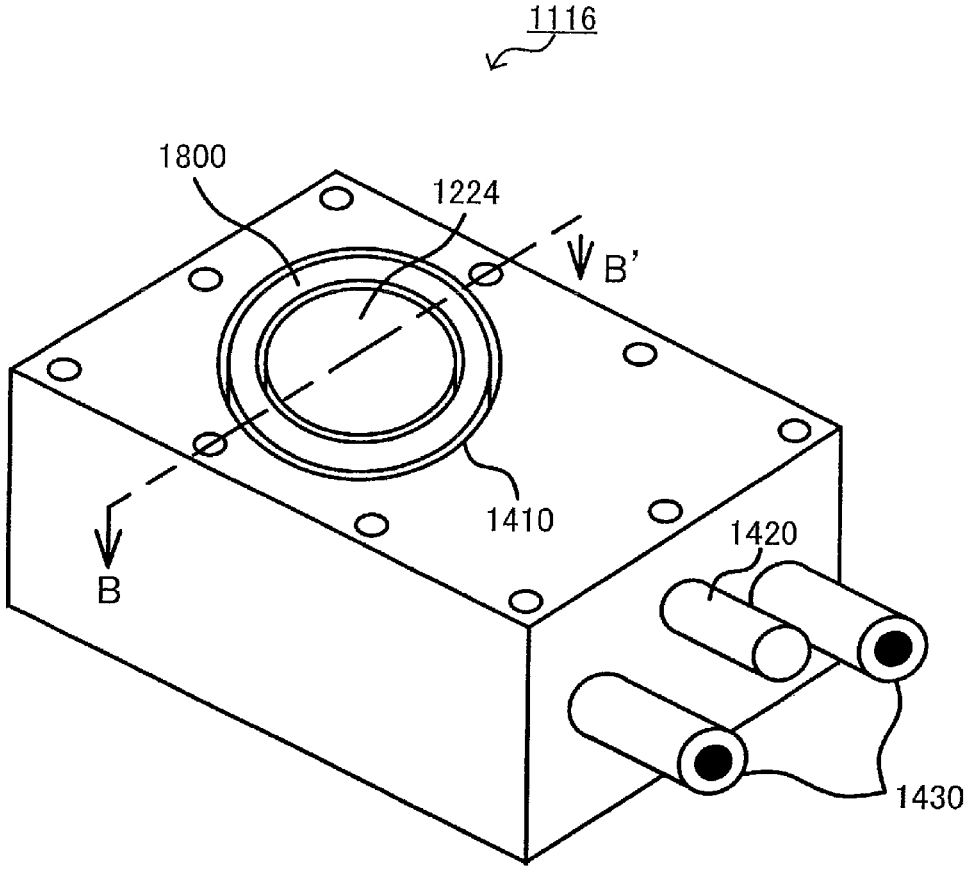

FIG. 13 shows a modification of the first storage container 1116, in which the first Peltier element 1110, the heat adjustment stage 1112 and the first heat transfer block 1114 are stored.

Figure 14:
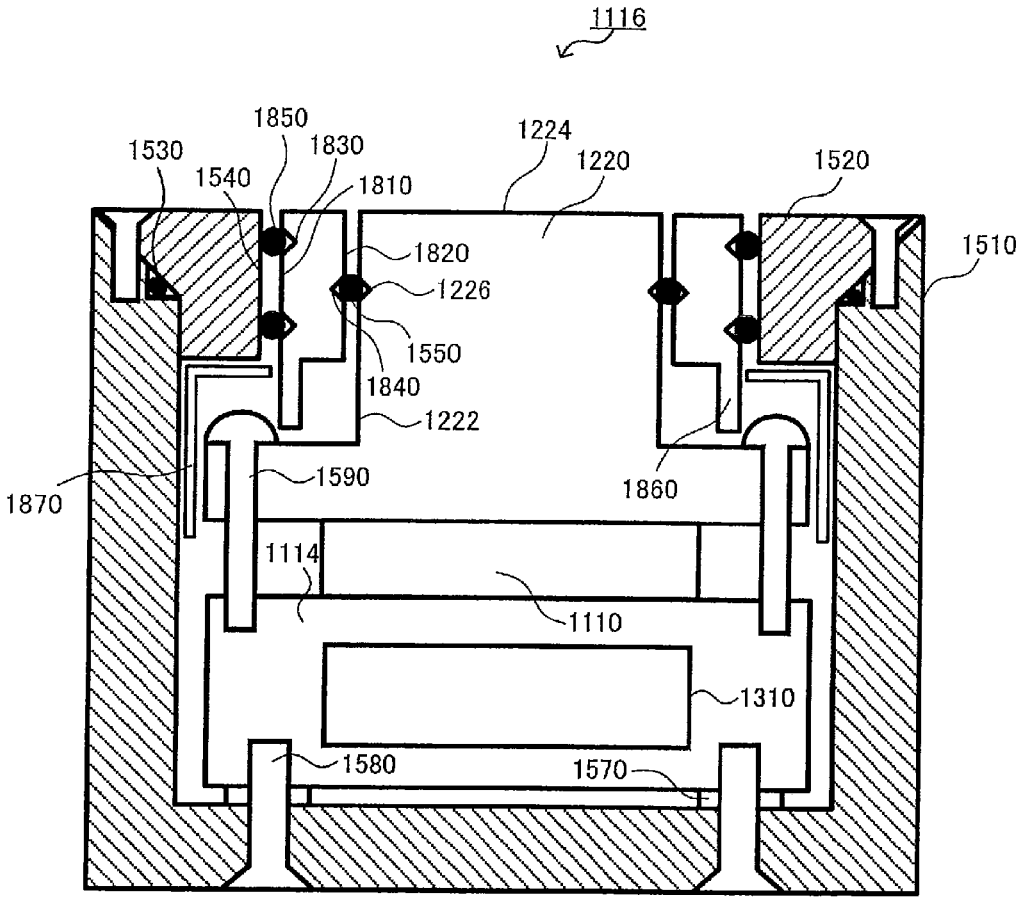

FIG. 14 is a cross-sectional view along line B-B' in FIG. 13.

EMBODIMENTS OF THE INVENTION

Figure 1:
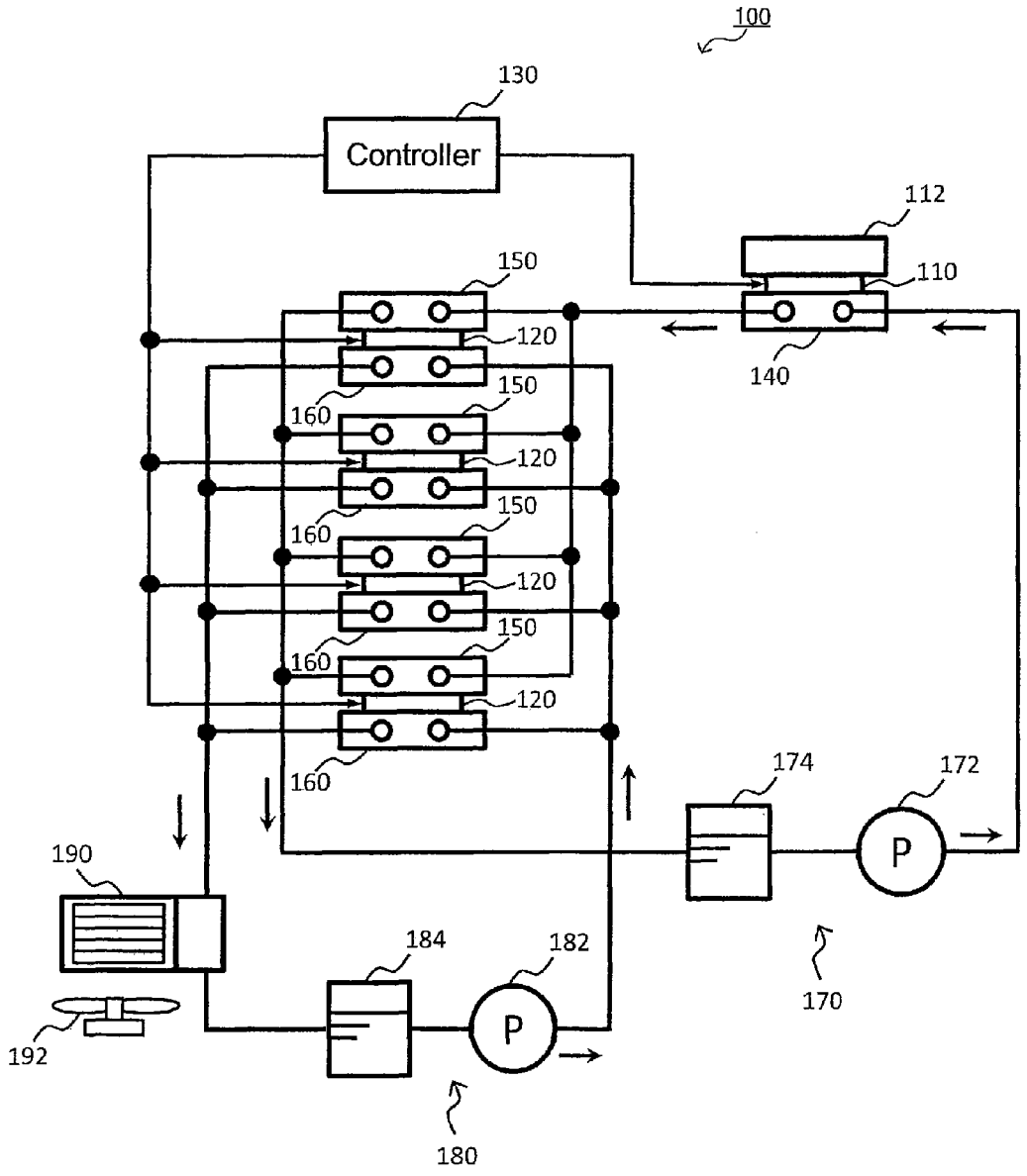
FIG. 1 shows a configuration of a temperature adjustment device 100 according to a first embodiment of the present invention.

FIG. 1 shows a configuration example of a temperature adjustment device 100 according to a first embodiment of the present invention. The temperature adjustment device 100 of this example functions as a cooling device for cooling a cooling target. The temperature adjustment device 100 is provided with a first Peltier element 110, a heat absorption plate 112, a second Peltier element 120, a controller 130, a first heat release block 140, a heat absorption block 150, a second heat release block 160, a primary circulation mechanism 170, a secondary circulation mechanism 180 and a heat exchanger 190.

Since the Peltier element used in the temperature adjustment device 100 has a well-known configuration, no detailed description thereof will be made; however, it has, for example, a configuration in which a P-type semiconductor and an N-type semiconductor are arranged in an alternating and parallel manner, one end of each semiconductor being joined to a substrate (hereinafter referred to as a first substrate), and, for each set of two neighboring semiconductors, each of the other ends of the semiconductors being joined to a substrate (hereinafter referred to as a second substrate), which is different from the first substrate, and in which, by supplying a direct current to a series circuit configured by the respective semiconductors and substrates, one of the first and second substrates acts as a heat generation side and the other substrate acts as a heat absorption side. The heat absorption surface of the first Peltier element 110 is thermally coupled to the cooling target.

The controller 130 controls a drive current to be supplied to the first Peltier element 110 and the second Peltier element 120 so as to cause one surface of the first Peltier element 110 and the second Peltier element 120 to function as a heat absorption surface and the other surface thereof to function as a heat release surface. The controller 130 may separately control the drive current to the first Peltier element 110 and the drive current to the second Peltier element 120, or it may commonly control the drive current to the first Peltier element 110 and the drive current to the second Peltier 120.

The first Peltier element 110 is an example of a first Peltier unit in the present invention. The first Peltier element 110 is formed in flat plate form and, by means of control by the controller 130, one surface thereof becomes a heat absorption surface and the other surface becomes a heat release surface. The heat absorption surface of the first Peltier element 110 functions as a heat absorption surface of the cooling device itself. More specifically, the heat absorption surface of the first Peltier element 110 is thermally coupled to the cooling target and cools such cooling target. In the present example, a heat absorption plate 112 is attached to the heat absorption surface of the first Peltier element 110 and thus, the first Peltier element 110 is thermally coupled to the cooling target via the heat absorption plate 112. As another example, the heat absorption surface of the first Peltier element 110 may make contact with the cooling target via a material such as grease, an elastic sheet or the like. By way of these materials, the contact area can be increased and the thermal resistance can be reduced. The heat release surface of the first Peltier element 110 is thermally coupled to the first heat release block 140.

The first heat release block 140 has a flow path 142. A primary refrigerant is made to flow through the flow path 142 of the first heat release block 140 by means of the primary circulation mechanism 170. In the present example, the first heat release block 140 is formed by a block made of a metal material such as copper, aluminum, brass, stainless-steel or the like. An inlet 144 and an outlet 146 of the flow path 142, for causing the primary refrigerant to flow therein, are provided on a lateral surface of the first heat release block 140. The first heat release block 140 is thermally coupled to the heat release surface of the first Peltier element 110, and receives heat from the heat release surface of the first Peltier element 110 and transfer it to the primary refrigerant. For example, the first heat release block 140 may make contact with the heat release surface of the first Peltier element 110 via a material such as grease, an elastic sheet or the like. Grease, an elastic sheet or the like may also be sandwiched between the first Peltier element 110 and the heat absorption plate 112. By way of these materials, the contact area can be increased and the thermal resistance can be reduced. The primary refrigerant discharged from the first heat release block 140 is supplied to the heat absorption block 150.

Although only one set of a first Peltier element 110 and a first heat release block 140 is provided in the temperature adjustment device 100 in the present example, a plurality of sets may be provided, with each set including a first Peltier element 110 and a first heat release block 140. In the case of providing such plurality of sets, with each set including a first Peltier element 110 and a first heat release block 140, the primary refrigerant may be supplied, in a parallel manner, to the plurality of first heat release blocks 140. By supplying the primary refrigerant to the plurality of first heat release blocks 140 in a parallel manner, the heat of the plurality of first Peltier elements 110 can be released in a uniform manner.

Four heat absorption blocks 150 are provided correspondingly to each second Peltier element 120. In the present example, the four heat absorption blocks 150 are connected in a parallel manner. As another example, the heat absorption blocks 150 may be connected in a serial manner, or both a serial connection and a parallel connection may be present. The heat absorption block 150 is formed by a block made of a metal material such as copper, aluminum, brass, stainless-steel or the like. Each heat absorption block 150 has a flow path 152. The primary refrigerant discharged from the first heat release block 140 is made to flow through the flow path 152 of the heat absorption block 150. The heat absorption block 150 is thermally coupled to the heat absorption surface of the second Peltier element 120 and transfers the heat of the primary refrigerant that flows through the flow path 152 to the heat absorption surface of the second Peltier element 120. For example, the heat absorption block 150 may make contact with the heat absorption surface of the second Peltier element 120 via a material such as grease, an elastic sheet or the like. By way of these materials, the contact area can be increased and the thermal resistance can be reduced.

The primary circulation mechanism 170 circulates the primary refrigerant between the first heat release block 140 and the heat absorption blocks 150. More specifically, the primary circulation mechanism 170 supplies the primary refrigerant discharged from the first heat release block 140 to each of the heat absorption blocks 150, and returns the primary refrigerant discharged from each of the heat absorption blocks 150 to the first heat release block 140. The primary circulation mechanism 170 is provided with a pump 172 and a reservoir tank 174. The reservoir tank 174 stores therein an excess of the primary refrigerant to be circulated. The pump 172 supplies the primary refrigerant from the reservoir tank 174 to the first heat release block 140.

In the present example, the respective heat absorption blocks 150 are provided, in a parallel manner, with respect to each other, and the primary refrigerant that is branched off by means of piping is supplied to each heat absorption block 150. The primary refrigerant discharged from each heat absorption block 150 is converged by means of piping and is returned to the reservoir tank 174. It should be noted that, as another example of a connection configuration, the heat absorption blocks 150 may be connected, in a serial manner by means of piping, or they may be provided such that both a serial connection and a parallel connection are present.

In the piping of the primary circulation mechanism 170, the primary refrigerant may be thermally insulated from the atmosphere. The piping on the pathway from the outlet of the heat absorption block 150 to the inlet of the first heat release block 140 is at least preferably thermally insulated from the atmosphere. Accordingly, it is possible to prevent the primary refrigerant cooled by the second Peltier element 120 in the heat absorption block 150 from becoming warm due to the temperature of the atmosphere, prior to being supplied to the first Peltier element 110. As a specific thermal insulation approach, the piping may be covered with a thermal insulating material or the piping itself may be formed by a thermal insulating material.

The primary refrigerant which is circulated by means of the primary circulation mechanism 170 may be water. Water is a preferable primary refrigerant since it has a relatively high thermal capacity, is inexpensive and easily available. When water is used as the primary refrigerant, the controller 130 may monitor the temperature of the primary refrigerant in the vicinity of the outlet of the heat absorption block 150 in order to prevent the primary refrigerant from freezing, and may control the drive current to the second Peltier element 120 in accordance with the temperature. It should be noted that any other liquid, such as an anti-freezing fluid or the like, or any gas may be used as the primary refrigerant.

The second Peltier element 120 is an example of a second Peltier unit in the present invention. In the present example, four second Peltier elements 120 are provided. Each second Peltier element 120 is formed in flat plate form and, by means of control by the controller 130, one surface thereof becomes a heat absorption surface and the other surface becomes a heat release surface. The heat absorption surface of each second Peltier element 120 is thermally coupled to a corresponding heat absorption block 150 and takes away the heat which is received by the heat absorption block 150 from the primary refrigerant. On the other hand, the heat release surface of the second Peltier element 120 is thermally coupled to the second heat release block 160.

Four second heat release blocks 160 are provided correspondingly to the second Peltier elements 120. Each second heat release block 160 has a flow path 162. A secondary refrigerant is made to flow in the flow path 162 of the second heat release block 160 by means of the secondary circulation mechanism 180. The second heat release block 160 is formed by a block made of a metal material such as copper, aluminum, brass, stainless-steel or the like. An inlet and an outlet of the flow path 162, for causing the secondary refrigerant to flow therein, are provided on a lateral surface of the second heat release block 160. Each second heat release block 160 is thermally coupled to the heat release surface of a corresponding second Peltier element 120, and receives heat from the heat release surface of the second Peltier element 120 and transfers it to the secondary refrigerant. The secondary refrigerant discharged from the second heat release blocks 160 is supplied to the heat exchanger 190. For example, the second heat release block 160 may make contact with the heat release surface of the second Peltier element 120 via a material such as grease, an elastic sheet or the like. By way of these materials, the contact area can be increased and the thermal resistance can be reduced.

Here, although the temperature adjustment device 100 in the present example is provided with four sets, with each set including a second Peltier element 120, a heat absorption block 150 and a second heat release block 160, any number of sets, with each set including a second Peltier element 120, a heat absorption block 150 and a second heat release block 160, is sufficient as long as it is at least one. The number of sets may be appropriately selected in accordance with the required cooling performance. Moreover, the sets, with each set including a second Peltier element 120, a heat absorption block 150 and a second heat release block 160, may be provided such that the number thereof can be changed. When the ability to cool the primary refrigerant is variable, in order to enhance the cooling function of the first Peltier element 110 by sufficiently cooling the primary refrigerant, it is preferable that the number of sets, with each set including a second Peltier element 120, a heat absorption block 150 and a second heat release block 160, is larger than the number of first Peltier elements 110.

The secondary circulation mechanism 180 circulates the secondary refrigerant between the second heat release blocks 160 and the heat exchanger 190. More specifically, the secondary circulation mechanism 180 supplies the secondary refrigerant discharged from the second heat release blocks 160 to the heat exchanger 190, and returns the secondary refrigerant discharged from the heat exchanger 190 to the second heat release block 160. The secondary circulation mechanism 180 is provided with a pump 182 and a reservoir tank 184. The reservoir tank 184 stores therein an excess of the secondary refrigerant to be circulated. The pump 182 supplies the secondary refrigerant from the reservoir tank 184 to the second heat release blocks 160.

In the present example, the respective second heat release blocks 160 are provided, in a parallel manner, with respect to each other, and the secondary refrigerant that is branched off by means of piping is supplied to each second heat release block 160. The secondary refrigerant discharged from each second heat release block 160 is converged by means of piping and is supplied to the heat exchanger 190. It should be noted that the second heat release blocks 160 may be connected, in a serial manner by means of piping, or they may be provided such that both a serial connection and a parallel connection are present.

The heat exchanger 190 receives the secondary refrigerant discharged from the second heat release blocks 160 and releases the heat thereof. For example, the heat exchanger 190 may be a radiator and such radiator may release the heat of the secondary refrigerant to the atmosphere. Wind may be applied by an air cooling fan 192 to the heat exchanger 190 in order to promote heat exchange. The secondary refrigerant discharged from the heat exchanger 190 is returned to the reservoir tank 184.

The secondary refrigerant which is circulated by the secondary circulation mechanism 180 may be water. Water is a preferable secondary refrigerant since it has a relatively high thermal capacity, is inexpensive and easily available. In addition, at room temperature, when a radiator is used as the heat exchanger 190, it is not necessary to take account of water getting frozen and thus, the handling thereof is simple. It should be noted that any other liquid, such as an anti-freezing fluid or the like, or any gas may be used as the secondary refrigerant.

In order to cool a cooling target by means of the temperature adjustment device 100 configured as described above, the drive current is supplied to the first Peltier element 110 and the second Peltier element 120 by means of the controller 130, and the primary refrigerant and the secondary refrigerant are circulated by means of the pump 172 and the pump 182. The controller 130 may monitor the temperature of the heat absorption surface of the first Peltier element 110 or the cooling target and control the drive current to be supplied to the first Peltier element 110 and the second Peltier element 120. For example, the controller 130 may provide control so as to cut off the drive current in response to a decrease in the monitored temperature below a predetermined value and to supply the drive current in response to an increase in the monitored temperature above a predetermined temperature. Alternatively, by making use of a thermometer (not shown), the controller 130 may monitor the temperature of the primary refrigerant in the vicinity of the heat absorption block 150 and control the drive current to the second Peltier element 120 such that freezing of the primary refrigerant is prevented. It should be noted that, by reversing the direction of the current passing through the first Peltier element from the direction during the cooling operation, it is also possible to operate the temperature adjustment device as a heating device. When the temperature adjustment device is operated as a heating device, the secondary refrigerant may be circulated or the circulation may be stopped. In addition, when the temperature adjustment device is operated as a heating device, the second Peltier element 120 may be stopped or a drive current may be passed through the second Peltier element 120 in a direction opposite to that during the cooling operation to heat the primary refrigerant and enhance the heating performance.

Figure 2:
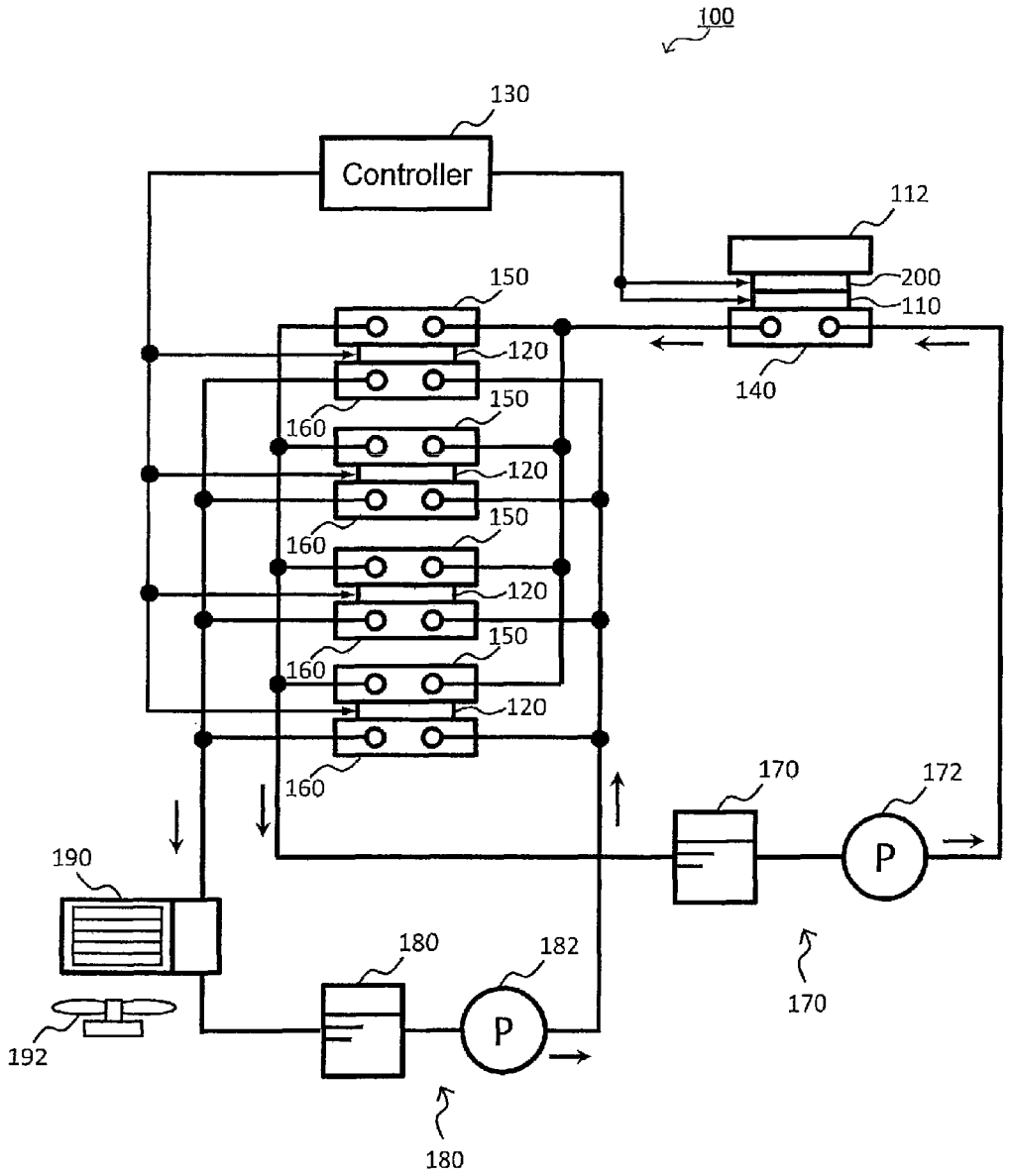
FIG. 2 shows a configuration of a temperature adjustment device 100 according to a modification of the first embodiment of the present invention.

FIG. 2 shows a modification of the first embodiment. The elements denoted by reference numbers common to both the first embodiment example and the present modification share common functions and configurations, unless otherwise described, and thus, the descriptions thereof will be omitted. The temperature adjustment device 100 of the present modification is provided with a first Peltier element 110, a heat absorption plate 112, a second Peltier element 120, a controller 130, a first heat release block 140, a heat absorption block 150, a second heat release block 160, a primary circulation mechanism 170, a secondary circulation mechanism 180, a heat exchanger 190 and a third Peltier element 200.

The third Peltier element 200 is provided correspondingly to the first Peltier element 110 and has a heat absorption surface and a heat release surface. The heat release surface of the third Peltier element 200 is thermally coupled to the heat absorption surface of the corresponding first Peltier element 110. The heat absorption surface of the third Peltier element 200 functions as a heat absorption surface of the cooling device itself. More specifically, the heat absorption surface of the third Peltier element 200 is thermally coupled to the cooling target and cools the cooling target. In the present example, the heat absorption plate 112 is attached to the heat absorption surface of the third Peltier element 200 and thus, the third Peltier element 200 is thermally coupled to the cooling target via the heat absorption plate 112. As another example, the heat absorption surface of the third Peltier element 200 may make contact with the cooling target via a material such as grease, an elastic sheet or the like. By way of these materials, the contact area can be increased and the thermal resistance can be reduced.

The configuration in which the first Peltier element 110 and the third Peltier element 200 are placed on top of each other is an example of the first Peltier unit in the present invention. It should be noted that, in the present modification, a two-tiered configuration of the first Peltier element 110 and the third Peltier element 200 is employed; however, a configuration may be employed in which more Peltier elements are placed on top of each other. Moreover, a configuration in which a plurality of Peltier elements are placed on top of each other, in a similar manner, may be employed in place of the second Peltier element 120 and such configuration may be used as the second Peltier unit in the present invention.

In addition to the drive current supplied to the first Peltier element 110 and the second Peltier element 120, the controller 130 controls the drive current supplied to the third Peltier element 200. By supplying the drive current by means of the controller 130 and by circulating the primary refrigerant and the secondary refrigerant by means of the pump 172 and the pump 182, the temperature adjustment device 100 can cool the cooling target which is thermally coupled to the heat absorption plate 112. The drive current supplied to the first Peltier element 110 and the third Peltier element 200 has a predetermined current value. The drive current ratio between the first Peltier element 110 and the third Peltier element 200 is optimized so that a maximum cooling capacity can be obtained. The controller 130 may make the amount of drive current to the first Peltier element 110 larger than the amount of drive current to the third Peltier element 200. In addition, the first Peltier element 110 and the third Peltier element 200 may be connected in a serial manner and controlled in a collective manner by the controller 130.

As another example, the controller 130 may monitor the temperature of the heat absorption surface of the third Peltier element 200 or the cooling target, and control the drive current to be supplied to the first Peltier element 110 and the third Peltier element 200. For example, the controller 130 may provide control so as to cut off the drive current in response to a decrease in the monitored temperature below a predetermined value and to supply the drive current in response to an increase in the monitored temperature above a predetermined temperature. Alternatively, the controller 130 may monitor the temperature of the primary refrigerant in the vicinity of the outlet of the heat absorption block 150 and control the drive current to the second Peltier element 120 such that freezing of the primary refrigerant is prevented. It should be noted that by controlling the operation of the second Peltier element and the circulation of the secondary refrigerant and by reversing the direction of the current passing through the first Peltier element 110 from the direction during the cooling operation, it is also possible to operate the temperature adjustment device as a heating device.

Figure 3:
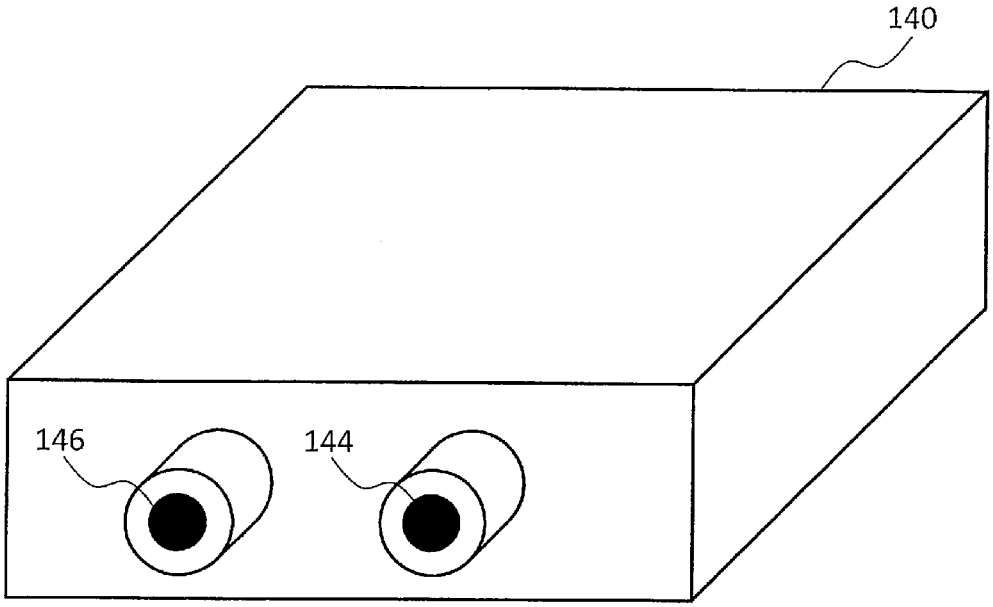
FIG. 3 shows an example of a first heat release block 140 used in the first embodiment.

FIG. 3 shows an example of the configuration of the first heat release block 140 used in the respective embodiments of the present invention. It should be noted that the heat absorption block 150 and the second heat release block 160 may have a similar configuration. In the present example, the first heat release block 140 has an area that covers the heat release surface of the first Peltier element 110, and such first heat release block 140 includes a top surface in contact with such heat release surface, a bottom surface opposite to the top surface and a plurality of lateral surfaces which are substantially perpendicular between the top surface and the bottom surface. The distance between the top surface of the first heat release block 140 and the flow path 142 is preferably small, as long as a sufficient strength can be maintained such that the pressure applied when the primary refrigerant is passed through the flow path 142 can be tolerated, in that the thermal resistance between the first Peltier element 110 and the primary refrigerant can be reduced. An inlet 144 and an outlet 146 are provided on a lateral surface of the first heat release block 140. In the present example, the inlet 144 and the outlet 146 are provided on the same lateral surface; however, each of the inlet 144 and the outlet 146 may be provided on a different lateral surface (for example, an opposing lateral surface). The flow path 142 of the present example is provided in a horseshoe shape in the first heat release block 140. As another example, the flow path 142 may meander through the first heat release block 140. The heat release effect can be enhanced by increasing the length of the flow path 142.

In the case of manufacturing the first heat release block 140 from a single metal ingot, a plurality of holes may be drilled from a plurality of lateral surfaces of the first heat release block 140 to form the flow path 142 in the first heat release block 140 and, by filling in the unnecessary holes, the flow path 142 can be formed without creating any holes in the top and bottom surfaces. In the case of the present example, in addition to drilling two holes for the inlet 144 and the outlet 146, a hole is drilled from another lateral surface, which is next to the lateral surface in which the inlet 144 and outlet 146 are provided, so as to form a path for making the two holes to communicate with each other and, by filling in the hole in such another lateral surface except for the path for making the inlet 144 and the outlet 146 to communicated with each other, the horseshoe-shaped flow path 142 is formed. It should be noted that the first heat release block 140 provided with the flow path 142 may be manufactured by forming such path 142 via cutting work performed on two pieces of metal ingots on the top surface side and the bottom surface side, and by joining such two pieces of metal ingots to each other.

FIG. 4 shows another example of the configuration of the first heat release block 140 used in the respective embodiments of the present invention. It should be noted that the heat absorption block 150 and the second heat release block 160 may have a similar configuration. In the present example, an opening is provided in the top surface of the first heat release block 140 and the flow path 142 is exposed. A concave portion 148 is provided surrounding the opening and an O-ring 400 is inserted into the concave portion 148. The upper end of the O-ring 400, in the condition where such O-ring is inserted in the concave portion 148, protrudes from the top surface of the first heat release block 140 by, for example, approximately 0.2 mm. More specifically, when the depth of the concave portion 148 is denoted by d1 and the thickness of the O-ring 400 that is not elastically deformed is denoted by d2, it is held that d2>d1.

FIG. 5 is a cross-sectional view of the heat absorption plate 112, the first Peltier element 110 and the first heat release block 140 in a condition where the first Peltier element 110 is attached to the first heat release block 140 shown in FIG. 4. Threaded holes are provided at four corners on the top surface of the first heat release block 140, and through-holes are provided in the heat absorption plate 112 at positions corresponding to the threaded holes. The heat absorption plate 112 is fastened to the first heat release block 140, with the first Peltier element 110 being sandwiched therebetween, by screws through the through-holes. The first Peltier element 110 is biased toward the first heat release block 140 by means of the heat absorption plate 112 from the heat absorption surface side, and the heat release surface of the first Peltier element 110 elastically deforms the O-ring 400 protruding from the top surface of the first heat release block 140 along the entire circumference of the opening. In this way, the opening is sealed and thus, the primary refrigerant is prevented from leaking onto the top surface side of the first heat release block 140, and the heat of the heat release surface can be directly transferred to the primary refrigerant by causing such primary refrigerant flowing in the flow path 142 to make direct contact with the heat release surface of the first Peltier element 110.

A spacer 114 is arranged between the through-hole of the heat absorption plate 112 and the threaded hole of the first heat release block 140. The height of the spacer 114 is larger than the thickness of the first Peltier element 110, only by a length (for example, 0.1 mm) smaller than the amount of the O-ring 400 protruding from the first heat release block 140 (i.e. 0.2 mm in the present example). More specifically, when the depth of the concave portion 148 is denoted by d1, the thickness of the O-ring 400 that is not elastically deformed is denoted by d2, the thickness of the first Peltier element 110 is denoted by T and the height of the spacer 114 is denoted by H, it is held that $H<d2-d1+T$. In this way, the lower limit of the distance between the heat absorption plate 112 and the first heat release block 140 is limited by the height of the spacer 114, and thus, even when the screw for attaching the heat absorption plate 112 is over-fastened, an appropriate amount of elastic deformation of the O-ring 400 can be obtained and thus, the first Peltier element 110 can be prevented from being damaged by making a contact with the top surface of the first heat release block 140.

According to the configuration of the temperature adjustment device 100 described above, a temperature adjustment device can be achieved in which cooling performance is enhanced and in which a high degree of quietness is obtained by cooling the primary refrigerant used for releasing heat from the first Peltier element with the second Peltier element 120. In addition, by making the number of the second Peltier elements 120 variable, the cooling performance for the primary refrigerant can be adjusted in accordance with the required cooling performance.

FIG. 6 shows a configuration example of a temperature adjustment device 1100 according to a second embodiment of the present invention. The temperature adjustment device 1100 of the present example adjusts the temperature of a target. The temperature adjustment device 1100 is provided with a first Peltier element 1110, a heat adjustment stage 1112, a first heat transfer block 1114, a first storage container 1116, a second Peltier element 1120, a second heat transfer block 1122, a third heat transfer block 1124, a second storage container 1126, a controller 1130, a primary circulation mechanism 1140, a secondary circulation mechanism 1150, a heat exchanger 1160 and a housing 1170. The first Peltier element 1110, the heat adjustment stage 1112 and the first heat transfer block 1114 are stored in the first storage container 1116. The second Peltier element 1120, the second heat transfer block 1122, the third heat transfer block 1124, the second storage container 1126, the controller 1130, the primary circulation mechanism 1140, the secondary circulation mechanism 1150 and the heat exchanger 1160 are stored in the housing 1170. The first storage container 1116 and the housing 1170 are connected to each other by piping for circulating a first heat medium and piping for supplying the drive current to the first Peltier element 1110, both of which will be described later.

The Peltier elements used for the temperature adjustment device 1100 are similar to those used in the first embodiment. Hereinafter, an external surface of the Peltier element, which is formed in flat plate form, on a first substrate side thereof will be referred to as a first surface of the Peltier element and an external surface on a second substrate side thereof will be referred to as a second surface of the Peltier element.

As described above, depending on the direction of the drive current, one of the first surface and the second surface of the Peltier element functions as a heat absorption surface and the other functions as a heat release surface. Thus, the target may be heated or cooled depending on the direction of the drive current. In the description below, the operation of the case in which the temperature adjustment device 1100 cools the target will be mainly described as an example.

When the temperature adjustment device 1100 cools the target, the controller 1130 controls the drive current to be supplied to the first Peltier element 1110 and the second Peltier element 1120 so as to cause the first surfaces of the first Peltier element 1110 and the second Peltier element 1120 to function as the heat absorption surfaces and to cause the second surfaces thereof to function as heat release surfaces. The controller 1130 may separately control the drive current to the first Peltier element 1110 and the drive current to the second Peltier element 1120, or it may commonly control the drive current to the first Peltier element 1110 and the drive current to the second Peltier element 1120. It should be noted that, in FIG. 6, in order to facilitate understanding of the invention, the drive current supply from the controller 1130 to the first Peltier element 1110 and the second Peltier element 1120 is schematically drawn with arrows; however, it goes without saying that, in reality, by means of two pieces of wiring, each of which is connected to the first or second substrate, the drive current is supplied to the Peltier elements and that the return current is returned therefrom.

The first Peltier element 1110 is formed in flat plate form and, by means of control by the controller 1130, the first surface functions as a heat absorption surface and the second surface functions as a heat release surface.

FIG. 7 shows an example of an exterior appearance of the heat adjustment stage 1112. The heat adjustment stage 1112 is thermally coupled to the first surface of the first Peltier element 1110 and transfers heat between the first surface of the first Peltier element 1110 and the target. The heat adjustment stage 1112 is made of a metal material which excels in heat transfer characteristics or processing characteristics, such as, for example, copper, aluminum, brass, stainless-steel or the like. It should be noted that when thermal insulation is necessary, the heat adjustment stage 1112 may be made of an insulator, such as ceramics or the like, or it may be formed by covering the metal material with the insulator, such as ceramics or the like. The heat adjustment stage 1112 is provided with: a base part 1210, the bottom surface thereof abutting the first surface of the first Peltier element 1110; and a projection part 1220 that projects onto the side of the base part 1210 that does not abut the first Peltier element. The projection part 1220 has a side wall surface 1222 which is substantially perpendicular to the first surface of the first Peltier element 1110 and an exposed surface 1224 which is exposed from the opening 1410 provided in the first storage container 1116. In the example shown in FIG. 7, the exposed surface 1224 is square; however, the shape of the exposed surface 1224 can be designed in conformity with the shape of the target. The bottom surface of the base part of the heat adjustment stage 1112 may make contact with the first surface of the first Peltier element 1110 via grease, an elastic sheet or the like. By way of these materials, the contact area can be increased and the thermal resistance can be reduced.

FIG. 8 shows an example of an external appearance of the first heat transfer block 1114. The first heat transfer block 1114 has a flow path 1310 in which a primary heat medium is passed therethrough and is thermally coupled to the second surface of the first Peltier element. For example, the first heat transfer block 1114 may make contact with the second surface of the first Peltier element 1110 via a material such as grease, an elastic sheet or the like. By way of these materials, the contact area can be increased and the thermal resistance can be reduced. The first heat transfer block 1114 transfers heat between the second surface of the first Peltier element 1110 and the primary heat medium. In the case of the temperature adjustment device 1100 cooling the target, the second surface of the first Peltier element 1110 is driven such that the second surface functions as a heat release surface, the first heat transfer block 1114 is thermally coupled to the second surface of the Peltier element 1110, and heat is received from the second surface of the first Peltier element 1110 and transferred to the primary heat medium.

The temperature of the primary heat medium flowing through the flow path of the first heat transfer block 1114 may reach the dew-point temperature or lower of the atmosphere outside the first storage container 1116. The primary heat medium may be, for example, a liquid such as water; however, it is preferable to use an anti-freezing fluid in order to prevent freezing. In order to prevent freezing of the primary heat medium, the controller 1130 may monitor the temperature of the primary heat medium and control the drive current in accordance with such temperature. The primary heat medium is circulated, by means of the primary circulation mechanism 1140, between the first heat transfer block and the second heat transfer block, which will be described later. In the present example, the first heat transfer block 1114 is formed by a block made of a metal material such as copper, aluminum, brass, stainless-steel or the like. An inlet 1320 and an outlet 1330 of the flow path 1310, for causing the primary heat medium to flow therein, are provided on a lateral surface of the first heat transfer block 1114. The primary heat medium discharged from the first heat transfer block 1114 is supplied to the second heat transfer blocks 1122.

Although only one set of a first Peltier element 1110, a heat adjustment stage 1112 and a first heat transfer block 1114 is provided in the temperature adjustment device 1100 in the present embodiment, a plurality of such sets may be provided. In the case of providing such plurality of sets, with each set including a first Peltier element 1110, a heat adjustment stage 1112 and a first heat transfer block 1114, the primary heat medium may be supplied to the plurality of the first heat transfer blocks 1114 in a parallel manner. By supplying the primary heat medium to the plurality of the first heat transfer blocks 1114 in a parallel manner, the heat of the plurality of the first Peltier elements 1110 can be released in a uniform manner or they can be heated in a uniform manner.

FIG. 9 shows an external appearance of the first storage container 1116 having a first Peltier element 1110, a heat adjustment stage 1112 and a first heat transfer block 1114 stored therein. FIG. 10 shows a cross-sectional view along line A-A' in FIG. 9. The first storage container 1116 seals the first Peltier element 1110 and the first heat transfer block 1114 therein in an air-tight manner. The first storage container 1116 is provided with an opening 1410, and from this opening 1410, the exposed surface 1224 which is part of the heat adjustment stage 1112 is exposed to the outside of the first storage container 1116. An electrical wiring feed-through 1420 for supplying the drive current to the first Peltier element 1110 and piping 1430 for circulating the primary heat medium in the first heat transfer block 1114 are also attached to the first storage container 1116; however, they are also attached in such a manner that the air-tightness is maintained.

In the case of the temperature adjustment device 1100 cooling the target, the temperature of the primary heat medium flowing through the first heat transfer block 1114 may become lower than the atmosphere temperature in the outside of the first storage container 1116. When the first heat transfer block 1114 and the first storage container 1116 are thermally and strongly coupled to each other, the primary heat medium may warm up due to the outside atmosphere and this leads to a decrease in the cooling performance of the temperature adjustment device 1100. For this reason, as shown in FIG. 10, the first heat transfer block 1114 is fixed inside the first storage container 1116 via a spacer 1570 made of a heat insulating material, and is thus thermally insulated from the external air. In addition, a fixing screw 1580 is used, which is also made of a heat insulating material. The heat insulating material forming the spacer 1570 and the screw 1580 may, for example, be a resin material. While maintaining the heat insulation between the heat release surface and the heat absorption surface, the heat adjustment stage 1112 and the first heat transfer block 1114 are pressed to each other, by means of a screw 1590, with the first Peltier element 1110 being sandwiched therebetween. As an example, the screw 1590 is made of a heat insulating material, such as a resin material or the like. In the case of the strength not being sufficient with the screw being made of a resin material, a bushing made of a heat insulating material may be inserted between the head part of the screw 1590 and the heat adjustment stage 1112 so as to thermally insulate between the heat release surface and the heat absorption surface.

The first storage container 1116 is configured by a body part 1510 and a lid part 1520. The body part 1510 and the lid part 1520 are closely attached to each other by sandwiching an O-ring 1530 therebetween in order to maintain the air-tightness. The lid part 1520 is provided with an opening 1410 for making the interior and the exterior of the first storage container 1116 communicate with each other. At this opening 1410, the exposed surface 1224 which is part of the heat adjustment stage is exposed to the outside of the first storage container 1116. An inner wall surface 1540 of the opening 1410 faces a side wall surface 1222 of the heat adjustment stage 1112 with a predetermined gap (clearance) sandwiched therebetween. A sealing member 1550, such as an O-ring, is arranged between the inner wall surface 1540 of the opening 1410 and the side wall surface 1222 of the heat adjustment stage 1112 in order to maintain the air-tightness of the first storage container 1116. A groove 1560 may be formed in the inner wall surface 1540 of the opening 1410 for positioning the sealing member 1550. The sealing member 1550 is compressed and deformed by being sandwiched between the groove 1560 and the side wall surface 1222 and seals off the gap between the inner wall surface 1540 and the side wall surface 1222. It should be noted that the groove 1560 for positioning the sealing member 1550 may be provided to the side wall surface 1222 of the heat adjustment stage 1112 or to both the inner wall surface 1540 and the side wall surface 1222. By means of such configuration as described above, the air-tightness of the interior of the first storage container 1116 is maintained. Thus, since the moisture is prevented from being supplied from the outside of the first storage container 1116, it is possible to suppress the generation of dew condensation in the interior of the first storage container 1116. The first storage container 1116 may be vacuumed and then sealed off. In addition, the interior of the first storage container 1116 may be filled with dry inert gas. Moreover, a desiccant agent, such as silica gel, may be placed inside the first storage container 1116.

Returning to FIG. 6, the primary circulation mechanism 1140 circulates the primary heat medium between the first heat transfer block 1114 and the second heat transfer blocks 1122. More specifically, the primary circulation mechanism 1140 supplies the primary heat medium discharged from the first heat transfer block 1114 to the second heat transfer blocks 1122 and returns the primary heat medium discharged from each of the second heat transfer blocks 1122 to the first heat transfer block 1114. The primary circulation mechanism 1140 is provided with a pump 1142 and a reservoir tank 1144. The reservoir tank 1144 stores therein an excess of the primary heat medium to be circulated. The pump 1142 supplies the primary heat medium from the reservoir tank 1144 to the first heat transfer block 1114.

The temperature adjustment device 1100 of the present embodiment is provided with four second heat transfer blocks 1122. The second heat transfer block 1122 is formed by a block made of a metal material such as copper, aluminum, brass, stainless-steel or the like. The second heat transfer blocks 1122 are provided as many as the second Peltier elements 1120 in a corresponding manner. Similarly to the first heat transfer block 1114 shown in FIG. 8, the second heat transfer block 1122 is provided with a flow path, an inlet and an outlet. The primary heat medium discharged from the first heat transfer block 1114 flows in the flow path. The second heat transfer block 1122 is thermally coupled to the first surface of the second Peltier element 1120 and transfers heat between the first surface of the second Peltier element 1120 and the primary heat medium. In the case of the temperature adjustment device 1100 cooling the target, the drive current is supplied by the controller 1130 such that the first surface of the second Peltier element 1120 functions as a heat absorption surface. For example, the second heat transfer block 1122 may make contact with the heat absorption surface of the second Peltier element 1120 via a material such as grease, an elastic sheet or the like. By way of these materials, the contact area can be increased and the thermal resistance can be reduced. The plurality of second heat transfer blocks 1122 are connected in a serial manner. The primary heat medium discharged from the first heat transfer block 1114 is supplied to the inlet of the furthest upstream second heat transfer block 1122. Sequentially, the primary heat medium is supplied to the next second heat transfer block 1122, and the primary heat medium discharged from the outlet of the furthest downstream second heat transfer block 1122 is stored in the reservoir tank 1144. In the present example, four second heat transfer blocks 1122 are connected in a serial manner; however, as another example, the second heat transfer blocks 1122 may be connected in a parallel manner, or both a serial connection and a parallel connection may be present. The primary heat medium discharged from the furthest downstream second heat transfer block 1122 may have a temperature at or lower than the dew-point temperature in the atmosphere outside of the second storage container 1126, as a result of being cooled by means of four second Peltier elements 1120.

The primary heat medium in the piping of the primary circulation mechanism 1140 may be thermally insulated from the atmosphere. The piping on the pathway from the outlet of the second heat transfer block 1122 to the supply port of the first heat transfer block 1114 is at least be preferably thermally insulated from the atmosphere. Accordingly, it is possible to prevent the primary heat medium cooled by the second Peltier element 1120 in the second heat transfer block 1122 from becoming warm, due to the temperature of the atmosphere, prior to being supplied to the first Peltier element 1110. As a specific thermal insulation approach, the piping may be covered with a thermal insulating material or the piping itself may be formed by a thermal insulating material.

Four second Peltier elements 1120 are provided in the present embodiment. Each second Peltier element 1120 is formed in flat plate form and, by means of control by the controller 1130, one surface thereof functions as a heat absorption surface and the other surface functions as a heat release surface. The first surface of each second Peltier element 1120 is thermally coupled to a corresponding second heat transfer block 1122. When the temperature adjustment device 1100 performs operations for cooling the target, by means of the drive current from the controller 1130, the first surface of the second Peltier element 1120 functions as a cooling surface and takes heat away from the primary heat medium, whereas the second surface of the second Peltier element 1120 is thermally coupled to the third heat transfer block 1124. It should be noted that, in the present embodiment, an example in which four second Peltier elements 1120 are provided is disclosed; however, any number of second Peltier elements may be provided in accordance with the required performance.

As shown in FIG. 6, in the present embodiment, one third heat transfer block 1124 is provided for four second Peltier elements 1120. As compared to the case in which one third heat transfer block is provided for each of the second Peltier elements 1120, this configuration does not need any piping or joints for connecting flow paths between a plurality of third heat transfer blocks and thus, it is advantageous in terms of reliability, ease of assembly and the like. The third heat transfer block 1124 is thermally coupled to the second surfaces of the second Peltier elements 1120 and transfers heat between the second surfaces of the second Peltier elements 1120 and the secondary heat medium. FIG. 11 shows an external appearance of the third heat transfer block 1124 in an exploded condition. The third heat transfer block 1124 is configured by a body part 1610 and a lid part 1620. A flow path 1630 is provided in the body part 1610 of the third heat transfer block 1124 as a concave portion. The secondary heat medium is caused to flow in the flow path 1630 by means of the secondary circulation mechanism 1180. The body part 1610 of the third heat transfer block 1124 is formed by a block made of a metal material such as copper, aluminum, brass, stainless-steel or the like. An inlet 1640 and an outlet 1650 of the flow path 1630 are provided on a lateral surface of the body part 1610 of the third heat transfer block 1124.

The lid part 1620 of the third heat transfer block 1124 is made of the same material as that of the body part 1610 and is formed in sheet form. The sheet-shaped lid part 1620 can be formed through sheet-metal processing and thus, it is possible to suppress the manufacturing cost. The lid part 1620 is attached to the body part 1610 by means of, for example, brazing such that leakage of the secondary heat medium flowing in the flow path 1630 is prevented. The top surface of the third heat transfer block 1124 is thermally coupled to the second surfaces of the four second Peltier elements 1120, and transfers heat between the second surface of each second Peltier element 1120 and the secondary heat medium. For example, the third heat transfer block 1124 may make contact with the second surface of the second Peltier element 1120 via a material such as grease, an elastic sheet or the like. By way of these materials, the contact area can be increased and the thermal resistance can be reduced. When the temperature adjustment device 1100 performs operations for cooling the target, heat is received from the second surface of the second Peltier element, which functions as the heat release surface, and is transferred to the secondary heat medium.

It should be noted that, in the present embodiment, the case in which one third heat transfer block 1124 is provided for four second Peltier elements 1120 is described as an example; however, one third heat transfer block 1124 may be provided correspondingly to each of the four second Peltier elements 1120. In this case, the four third heat transfer blocks 1124 may be dependently connected to each other, similarly to the second heat transfer blocks 1122, or they may be connected in a parallel manner. Alternatively, they may be provided such that both a parallel connection and a serial connection are present. In a configuration where a second Peltier element 1120, a second heat transfer block 1122 and a third heat transfer block 1124 are assembled into one set, it is easily possible to provide an additional second Peltier element 1120 and thus, the configuration can be easily changed in accordance with the required performance.

The secondary heat medium discharged from the third heat transfer block 1124 is circulated between the third heat transfer block 1124 and the heat exchanger 1160, which will be described later, by means of the secondary circulation mechanism 1150. More specifically, the secondary circulation mechanism 1150 supplies the secondary heat medium discharged from the third heat transfer block 1124 to the heat exchanger 1160 and returns the secondary medium discharged from the heat exchanger 1160 to the third heat transfer block 1124. The secondary circulation mechanism 1150 is provided with a pump 1152 and a reservoir tank 1154. The reservoir tank 1154 stores therein an excess of the secondary heat medium to be circulated. The pump 1152 supplies the secondary heat medium from the reservoir tank 1154 to the third heat transfer block 1124.

The heat exchanger 1160 receives the secondary heat medium discharged from the third heat transfer block 1124 and releases the heat thereof. For example, the heat exchanger 1160 may be a radiator and such radiator may release the heat of the secondary heat medium to the atmosphere. Wind may be applied by an air cooling fan 1162 to the heat exchanger 1160 in order to promote heat exchange. The secondary heat medium discharged from the heat exchanger 1160 is returned to the reservoir tank 1154.

The secondary heat medium which is circulated by the secondary circulation mechanism 1150 may be water. Water is a preferable secondary heat medium since it has a relatively high thermal capacity, is inexpensive and easily available. In addition, at room temperature, when a radiator is used as the heat exchanger 1160, it is not necessary to take account of water getting frozen and thus, the handling thereof is simple. It should be noted that any other liquid, such as an anti-freezing fluid or the like, or any gas may be used as the secondary heat medium.

FIG. 12 shows the second Peltier element 1120, the second heat transfer block 1122 and the third heat transfer block 1124 stored in the second storage container 1126. The second Peltier element 1120, the second heat transfer block 1122 and the third heat transfer block 1124 are stored in the second storage container 1126 in an air-tight and sealed manner. The second storage container 1126 is configured by a body part 1710 and a lid part 1720. The body part 1710 and the lid part 1720 are closely attached to each other by sandwiching a sealing member 1730, such as a flat packing or the like, therebetween in order to maintain the air-tightness. The third heat transfer block 1124 is fixed to the second storage container 1126, in a direct contact manner, by means of a screw 1740. The screw 1740 may be made of a metal material having relatively high thermal conductivity. By being in direct contact with the second storage container 1126, the third heat transfer block 1124 not only can transfer heat from the second surface, which functions as a heat release surface, of the second Peltier element 1120 to the secondary heat medium, but can also promote heat release by making use of the second storage container 1126 as a heat sink. While maintaining the heat insulation between the heat release surface and the heat absorption surface, the second heat transfer block 1122 and the third heat transfer block 1124 are pressed to each other, by means of a screw 1750, with the second Peltier element 1120 being sandwiched therebetween. As an example, the screw 1750 is made of a heat insulating material, such as a resin material or the like. In the case of the strength not being sufficient with the screw made of a resin material, a bushing made of a heat insulating material may be inserted between the head part of the screw 1750 and the second heat transfer block 1122 so as to thermally insulate between the heat release surface and the heat absorption surface. An electrical wiring feed-through for supplying the drive current to the second Peltier element 1120, wiring for circulating the primary heat medium in the second heat transfer block 1122, wiring for circulating the secondary heat medium in the third heat transfer block 1124 and so on are also attached to the second storage container 1126; however, they are also attached in such a manner that the air-tightness is maintained. By means of such configuration as described above, the air-tightness in the interior of the second storage container 1126 is maintained. Thus, since the moisture is prevented from being supplied from the outside of the second storage container 1126, it is possible to suppress the generation of dew condensation in the interior of the second storage container 1126. The second storage container 1126 may be vacuumed and then sealed off. In addition, the interior of the second storage container 1126 may be filled with dry inert gas. Moreover, a desiccant agent, such as silica gel, may be placed inside the second storage container 1126.

In order to cool a cooling target by means of the temperature adjustment device 1100 configured as described above, the drive current is supplied, by means of the controller 1130, such that the first surfaces of the first Peltier element 1110 and the second Peltier element 1120 become heat absorption surfaces, and the primary heat medium and the secondary heat medium are circulated by the pump 1142 and the pump 1152. The controller 1130 may monitor the temperature at the exposed surface 1224 of the heat adjustment stage 1112 or of the cooling target and control the drive current to be supplied to the first Peltier element 1110 and/or the second Peltier element 1120. For example, the controller 1130 may provide control so as to cut off the drive current in response to a decrease in the monitored temperature below a predetermined value and to supply the drive current in response to an increase in the monitored temperature above a predetermined temperature. Alternatively, by making use of a thermometer (not shown), the controller 1130 may monitor the temperature of the primary heat medium in the vicinity of the outlet of the second heat transfer block 1122 and control the drive current to the second Peltier element 1120 such that freezing of the primary heat medium is prevented. It should be noted that, by reversing the direction of the current passing through the first Peltier element from the direction during the cooling operation, the temperature adjustment device 1100 can also heat the target. In this case, the secondary heat medium may be circulated or the circulation may be stopped. In addition, when the temperature adjustment device 1100 performs operations for heating the target, the second Peltier elements 1120 may be stopped, or a drive current may be passed through the second Peltier element 1120 in a direction opposite to the direction during the cooling operation to heat the primary heat medium and enhance the heating performance.

According to the configuration of the temperature adjustment device 1100 described above, a temperature adjustment device can be achieved in which cooling performance is enhanced and in which a high degree of quietness can be obtained by cooling the primary heat medium used for releasing heat from the first Peltier element 1110 with the second Peltier element 1120. In addition, since the first storage container 1116 and the second storage container 1126 store therein the Peltier elements and the heat transfer blocks placed on the periphery thereof, in an air-tight and sealed manner, it is possible to suppress the generation of dew condensation in the interior of the first storage container 1116 and the second storage container 1126.

FIG. 13 shows a modification of the first storage container 1116 in which the first Peltier element 1110, the heat adjustment stage 1112 and the first heat transfer block 1114 in the above-described second embodiment are stored. In addition, FIG. 14 is a cross-sectional view along line B-B' in FIG. 13. It should be noted that, in FIGS. 13 and 14, members denoted by the same reference numbers as those used in FIGS. 6 to 12 have configurations similar to those described in relation to FIGS. 6 to 12, unless otherwise described, and thus, the descriptions thereof will be omitted in terms of avoiding redundant descriptions.

In the present modification, as shown in FIGS. 13 and 14, a tubular heat-resistant ring 1800 is arranged between the projection part 1220 of the heat adjustment stage 1112 and the lid part 1520 of the first storage container 1116. More specifically, the heat-resistant ring 1800 is arranged between a region of the heat adjustment stage 1112, which is exposed at the opening 1410, and the opening 1410. The heat-resistant ring 1800 is made of a high heat-resistant material such as polyether ether ketone (PEEK) and is formed in tubular form. The projection part 1220 of the heat adjustment stage 1112 in the present modification is formed in cylindrical form in conformity with the shape of the heat-resistant ring 1800. The opening 1410 in the lid part 1520 is also provided as a circular through-hole in conformity with the shape of the heat-resistant ring 1800. The outer wall surface 1810 of the heat-resistant ring 1800 faces the inner wall surface 1540 of the opening 1410 provided in the lid part 1520 with a predetermined gap (clearance) sandwiched therebetween, and the inner wall surface 1820 of the heat-resistant ring 1800 faces the side wall surface 1222 of the projection part 1220 with a predetermined gap sandwiched therebetween.

A groove 1830 is formed in the outer wall surface 1810 of the heat-resistant ring 1800. In the present modification, there is no groove formed in the inner wall surface 1540 of the opening 1410 of the lid part 1520. A sealing member 1850, such as an O-ring or the like, made of an elastic material, is placed between the inner wall surface 1540 and the groove 1830. The sealing member 1850 is compressed and deformed by being sandwiched between the inner wall surface 1540 and the groove 1830 and seals off the gap between the inner wall surface 1540 and the outer wall surface 1810. One or a plurality of grooves 1830 and sealing members 1850 may each respectively be provided. The number thereof can be determined in accordance with the required performance (i.e. heat insulation performance, air-tightness performance, retaining force or the like). As shown in FIG. 14, in the present modification, two sets of a groove 1830 and a sealing member 1850 are provided, A groove 1840 is formed in the inner wall surface 1820 of the heat-resistant ring 1800. In addition, a groove 1226 is formed in the side wall surface 1222 of the heat adjustment stage 1112. A sealing member 1550, such as an O-ring or the like, is placed between the inner wall surface 1820 and the groove 1226 in order to maintain the air-tightness of the first storage container 1116. The sealing member 1550 is compressed and deformed by being sandwiched between the groove 1840 and the groove 1226 and seals off the gap between the inner wall surface 1820 and the side wall surface 1222. The sealing member 1550 ensures the air-tightness of the first storage container 1116 and also provides positioning of the heat-resistant ring 1800 and the heat adjustment stage 1112 in the vertical direction. One or a plurality of grooves 1840, grooves 1226 and sealing members 1550 may each respectively be provided. The number thereof can be determined in accordance with the required performance (i.e. heat insulation performance, air-tightness performance, retaining force or the like). In addition, the grooves that sandwich the sealing member 1550 therebetween may be provided to only one of the side wall surface 1222 of the heat adjustment stage 1112 and the inner wall surface 1820 of the heat-resistant ring 1800. In this case, the grooves that sandwich the sealing member 1850 therebetween are provided to both the inner wall surface 1540 of the lid part 1520 and the outer wall surface 1810 of the heat-resistant ring 1800, and it is preferable to provide positioning of the lid part 1520 and the heat-resistant ring 1800 in the vertical direction, by having the grooves face each other while sandwiching the sealing member 1850 therebetween.

By means of the configuration in which the heat-resistant ring 1800 is arranged between the projection part 1220 of the heat adjustment stage 1112 and the lid part 1520 of the first storage container 1116, it is possible to suppress the thermal load applied upon the lid part 1520 of the first storage container 1116 due to the change in temperature of the heat adjustment stage 1112, while the air-tightness of the interior of the first storage container 1116 is maintained.

A protrusion 1860 is provided at the periphery of the bottom surface of the heat-resistant ring 1800. Such protrusion 1860 makes contact with the top surface of the base part 1210 of the heat adjustment stage 1112 when the heat-resistant ring 1800 shifts downwards from a predetermined position with respect to the heat adjustment stage 1112, thereby an excessive positional displacement is prevented. The protrusion part 1860 may be provided over the whole circumference of the bottom surface of the heat-resistant ring 1800 or may be partially provided to the periphery of the bottom surface.

In the present modification, a heat shielding member 1870 is arranged on the inner wall surface that faces the heat adjustment stage 1112 in the first storage container 1116. The heat shielding member 1870 reflects away the radiation from the heat adjustment stage 1112 and prevents the transfer of heat due to such radiation to the first storage container 1116. It should be noted that it is sufficient for the heat shielding member 1870 to be arranged, at least, on the inner wall surface facing the heat adjustment stage 1112 in the first storage container 1116, and such heat shielding member may be arranged over the entire inner wall surface of the first storage container 1116. The heat shielding member 1870 can be made from, for example, an aluminum thin film. As another example, a heat shielding film may be formed on a required region of the inner wall surface of the first storage container 1116 by means of vapor deposition, plating or the like.

According to the configuration of the present modification, the heat shielding performance with respect to the first Peltier element 1110, the heat adjustment stage 1112, the first heat transfer block 1114 and the like, stored inside the first storage container 1116 can be enhanced by means of the heat-resistant ring 1800 and the heat shielding member 1870.

As set forth above, the present invention has been described using embodiments; however, the technical scope of the present invention is not limited to the scope of the description of such embodiments. It is obvious to those skilled in the art that various variations and modifications may be made to the above-described embodiments. It is clear from the descriptions in the claims that the embodiments including such variations and modifications are also encompassed in the technical scope of the present invention.

DESCRIPTIONS OF REFERENCES NUMERALS

100 Temperature adjustment device
110 First Peltier element
112 Heat absorption plate
120 Second Peltier element
130 Controller
140 First heat release block
150 Heat absorption block
160 Second heat release block
170 Primary circulation mechanism
172 Pump
174 Reservoir tank
180 Secondary circulation mechanism
182 Pump
184 Reservoir tank
190 Heat exchanger
200 Third Peltier element
400 O-ring
1100 Temperature adjustment device
1102 Housing
1110 First Peltier element
1112 Heat adjustment stage
1114 First heat transfer block
1116 First storage container
1120 Second Peltier element
1122 Second heat transfer block
1124 Third heat transfer block
1126 Second storage container
1130 Controller
1140 Primary circulation mechanism
1142 Pump
1144 Reservoir tank
1150 Secondary circulation mechanism
1152 Pump
1154 Reservoir tank
1160 Heat exchanger

The invention claimed is:

1. A heat transfer unit comprising:

a storage container that has an opening for making an interior and an exterior of the storage container to communicate with each other;

a heat adjustment stage, a temperature of the heat adjustment stage being adjustable, the heat adjustment stage having an exposed surface exposed at the opening and a side wall surface, and the heat adjustment stage being placed inside the storage container;

a tubular heat-resistant member that has an inner wall surface and an outer wall surface, the tubular heat-resistant member being placed between a region of the heat adjustment stage, which is exposed at the opening, and the opening;

a first sealing member that is compressed and deformed by being sandwiched between the inner wall surface of the opening and the outer wall surface of the heat-resistant member, the first sealing member sealing off the gap between the inner wall surface of the opening and the outer wall surface of the heat-resistant member; and a second sealing member that is compressed and deformed by being sandwiched between the inner wall surface of the heat-resistant member and the side wall surface of the heat adjustment stage, the second sealing member sealing off the gap between the inner wall surface of the heat resistant member and the side wall surface of the heat adjustment stage.

2. The heat transfer unit according to claim 1, further comprising:

a heat shielding member arranged at least, on a part on a part of the inner wall surface in the storage container facing the heat adjustment stage.

3. The heat transfer unit according to claim 1, wherein the heat-resistant member has a protrusion provided at the periphery of the bottom surface thereof.

4. The heat transfer unit according to claim 1, further comprising:

a Peltier element that has a first surface functioning as a heat absorption surface or a heat release surface, depending on the direction of a drive current, and a second surface functioning as a surface different from the first surface, out of the heat absorption surface or the heat release surface, depending on the direction of the drive current, the first surface of the Peltier element being thermally coupled to the heat adjustment stage; and a first heat transfer block that has a flow path in which a heat medium flows, the first heat transfer block being thermally coupled to the second surface of the Peltier element and transferring heat between the second surface and the heat medium.

5. A temperature adjustment device comprising:

the heat transfer unit according to claim 4;

a controller that controls the drive current of the Peltier element;

a heat exchanger that receives the heat medium discharged from the first heat transfer block and exchange the heat thereof; and a circulation mechanism that circulates the heat medium between the first heat transfer block and the heat exchanger.

6. The heat transfer unit according to claim 1, further comprising at least one groove for positioning the first sealing member in the outer wall surface of the heat-resistant member, and at least one groove for positioning the second sealing member in the inner wall surface of the heat-resistant member.

* * * * *